US008044611B2

(12) United States Patent
Tanaka

(10) Patent No.: US 8,044,611 B2
(45) Date of Patent: Oct. 25, 2011

(54) LED CONTROL DEVICE

(75) Inventor: Sinichi Tanaka, Tokyo (JP)

(73) Assignee: Texas Instruments Incorporated, Dallas, TX (US)

( * ) Notice: Subject to any disclaimer, the term of this patent is extended or adjusted under 35 U.S.C. 154(b) by 439 days.

(21) Appl. No.: 12/403,128

(22) Filed: Mar. 12, 2009

(65) Prior Publication Data

US 2009/0230885 A1 Sep. 17, 2009

(30) Foreign Application Priority Data

Mar. 13, 2008 (JP) ..... 2008-063900

(51) Int. Cl.
*G05F 1/00* (2006.01)

(52) U.S. Cl. ..... 315/297; 315/299; 315/307

(58) Field of Classification Search ..... 315/185 R, 315/186, 192, 193, 209 R, 210, 291, 294, 315/297, 307, 308, 312, 313, 320, 361
See application file for complete search history.

(56) References Cited

U.S. PATENT DOCUMENTS

| | | | | |
|---|---|---|---|---|
| 4,887,074 | A * | 12/1989 | Simon et al. | 345/82 |
| 2003/0067281 | A1 * | 4/2003 | Wilk et al. | 320/132 |
| 2003/0085854 | A1 * | 5/2003 | Tsuji | 345/82 |
| 2006/0125425 | A1 * | 6/2006 | Yen | 315/312 |
| 2008/0007320 | A1 * | 1/2008 | Lu | 327/518 |

* cited by examiner

*Primary Examiner* — Douglas W Owens
*Assistant Examiner* — Jianzi Chen
(74) *Attorney, Agent, or Firm* — John J. Patti; Wade J. Brady, III; Frederick J. Telecky, Jr.

(57) ABSTRACT

An LED controller is provided that can easily control light-on testing of LEDs. A super voltage can be added to a signal including a low voltage and a high voltage. When the super voltage is not detected, LED driving circuit is operated in normal mode. When the super voltage is detected, LED driving circuit is operated in test mode. In test mode, the LEDs are turned on by a test signal directly input to LED driving circuit instead of by light emission data sent from shifter register to storage circuit. Accordingly, light-on testing of LEDs can be carried out easily.

12 Claims, 4 Drawing Sheets

LED CONTROL DEVICE

CROSS REFERENCE TO RELATED APPLICATIONS

This patent application claims priority from Japanese Patent Application No. 2008-063900, filed Mar. 13, 2008, the entirety of which is incorporated herein by reference.

FIELD OF THE INVENTION

The invention pertains generally to Light Emitting Diode (LED) backlight panels, and in particular, to an LED controller that inspects LEDs on an LED backlight panel.

BACKGROUND

LEDs have attracted much attention as backlights for liquid crystal display devices due to a long service life and low power consumption. In recent years, LEDs have been used not only in liquid crystal display devices for portable phones but also in liquid crystal display devices of TVs. One consideration when LEDs are used for backlighting, though, is uniformity of light emission intensity across the display. In order to obtain general uniformity of the light emission intensity, LEDs are arranged on a substrate, and a light emission control circuit is coupled to each LED to control the brightness and the light emission time of the LED. However, compactness can be an issue due to the large number of wires that are generally employed In conventional devices, LED controllers, each of which has integrated light emission control circuits, are coupled in series. The light emission data indicating the light emission condition of each LED is transmitted serially in synchronization with a clock signal from light emission control circuits in the previous stage to those in the next stage. An external latch signal is input to each light emission control circuit to simultaneously change the light emission status of each LED. Accordingly, light emission data can be input by one wire to several LED controllers coupled in series, and the light emission conditions of LEDs coupled to the respective LED controllers can be set by one wire. However, when the light emission data for LEDs is transmitted serially in this manner, a long time delay is present when transmitting the light emission data during light-on inspection for each LED, and it is difficult to freely turn on/off the LEDs.

SUMMARY

A preferred embodiment of the present invention, accordingly, provides an LED controller that has a data input terminal to which are input light emission data having a high voltage level and a low voltage level and used for specifying the light emission statuses of LEDs, a shift register that sequentially stores the light emission data input from the data input terminal and overflows the light emission data exceeding the storage capacity in the old input order, a plurality of current output terminals to which the LEDs should be respectively coupled, a storage circuit that stores the light emission data stored in the shift register, and an LED driving circuit that can operate in a normal mode by making current flow to the current output terminals arranged corresponding to the storage circuit according to the content of the storage circuit. The LED controller also has a signal value detecting circuit that can detect whether the input control signal is a super voltage in a voltage range wherein the voltage range of the high voltage and the voltage range of the low voltage do not overlap; when the signal detecting circuit does not detect the super voltage, the LED driving circuit operates in the normal mode; when the signal detecting circuit detects the super voltage, the LED driving circuit operates in a test mode by making current flow to the current output terminals independent of the content stored in the storage circuit according to a test signal input into the LED driving circuit.

Also, according to a preferred embodiment of the present invention, the LED driving circuit is an LED controller constructed such that it can change the magnitude of the current flowing to the current output terminals stepwise in the normal mode. A plurality of set current values between the maximum current and the minimum current respectively correspond to the light emission data stored in the storage circuit. In this LED controller, in the test mode, the maximum current or minimum current is supplied to the current output terminals according to the test signal.

A preferred embodiment of the present invention also provides an LED driving circuit including a plurality of current supply terminals (current output terminals) coupled to LEDs, a data input terminal to which are supplied driving data (light emission data) illustrating the current values provided to the LEDs, a shift register that sequentially holds a plurality of driving data input consecutively from the data input terminal, a data output terminal that outputs the driving data transferred from the shift register, a plurality of storage circuits that store the driving data held in the shift register, a plurality of current supply circuits that supply driving currents corresponding to the driving data held in the storage circuits to the current supply terminals, and a test mode detecting circuit (signal value detecting circuit) that detects a test mode and outputs a test mode signal. The current supply circuits have a plurality of current circuits (current sources) coupled in parallel with the current supply terminals, and a plurality of control circuits (logic circuits) that respectively control the current supply of the current circuits. The control circuit has a first logic circuit that controls the current supply of the current circuit corresponding to the value of the driving data, a second logic circuit that controls the current supply of the current circuit corresponding to the test mode signal, and a current supply instruction signal (light-on signal), and an operation circuit that inactivates the first logic circuit corresponding to the test mode signal.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
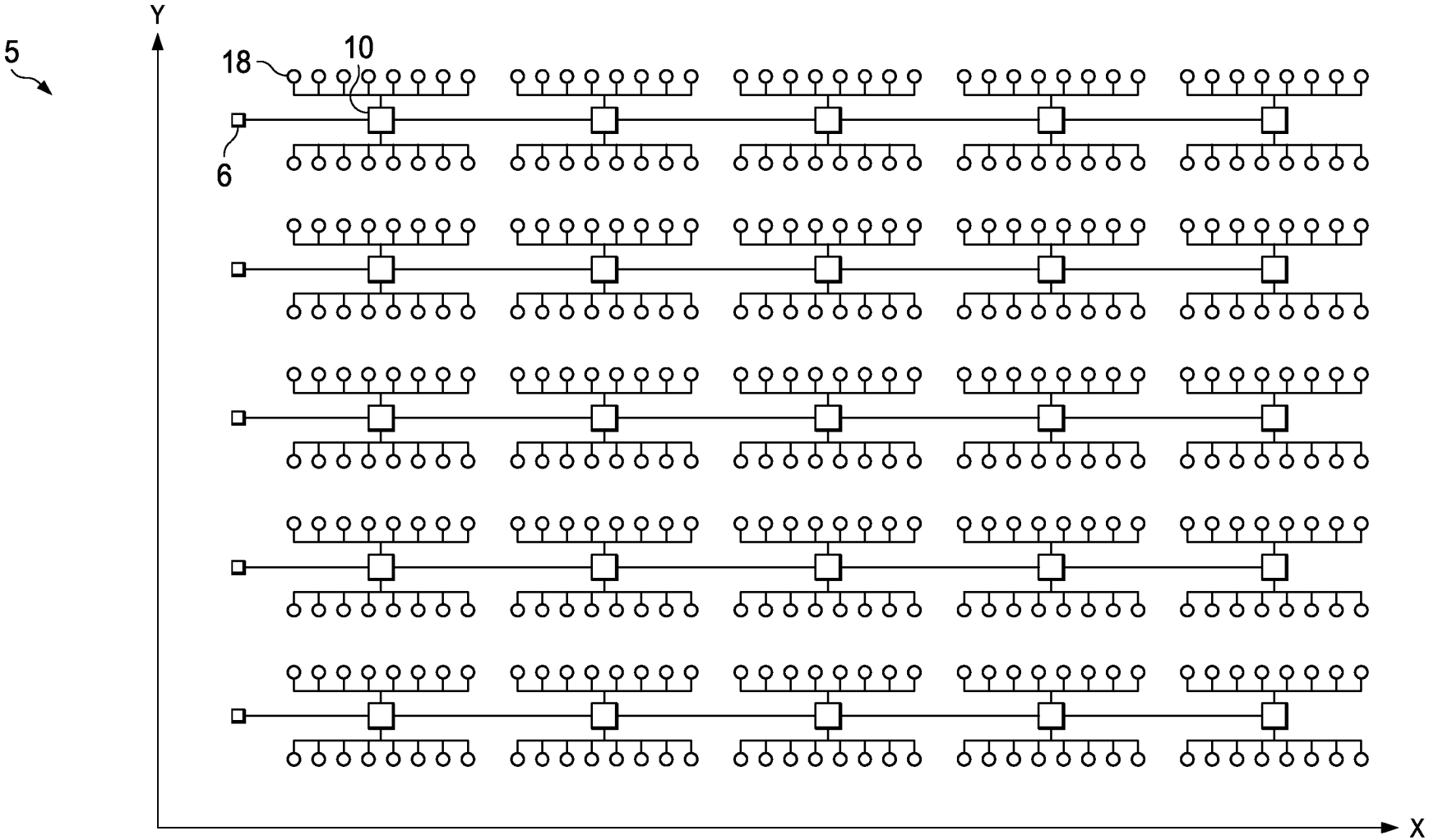
FIG. 1 is a diagram of an example of an LED backlight panel in accordance with a preferred embodiment of the present invention.

Refer now to the drawings wherein depicted elements are, for the sake of clarity, not necessarily shown to scale and wherein like or similar elements are designated by the same reference numeral through the several views.

Referring to FIG. 1 of the drawing, the reference numeral 5 generally designates an LED backlight panel. The backlight panel 5 is generally comprised of LEDs 18 and LED controllers 10. Each controller 10 controls several LEDs 18 (preferably 16). The controllers 10 are arranged in rows, and each controller 10 in a row is coupled in series with one another. Each row is then accessed through terminal 6.

Figure 2:
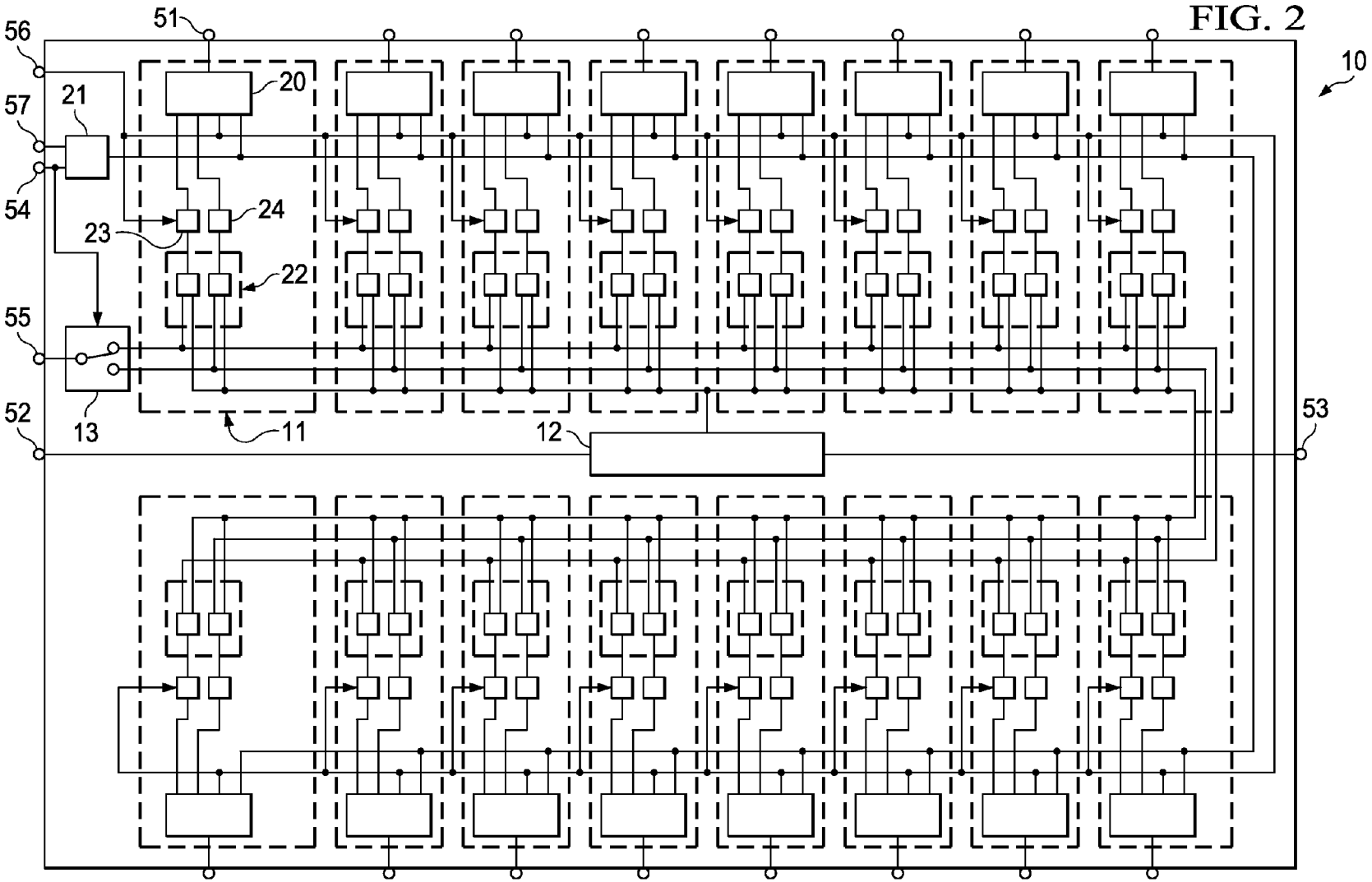
FIG. 2 is a block diagram of an LED controller of FIG. 1.
Figure 3:
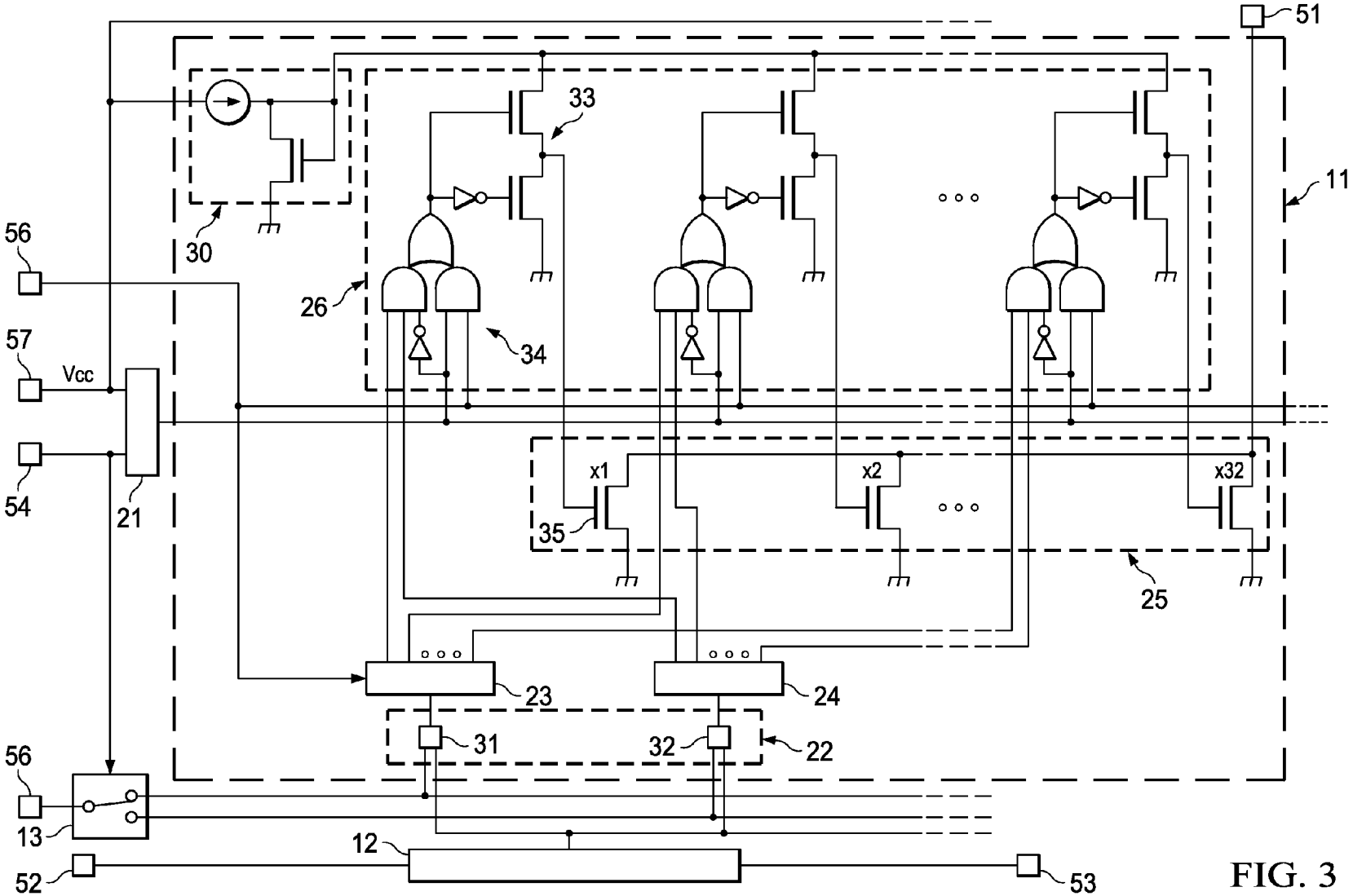
FIG. 3 is a block diagram of the internal circuit of the LED controller of FIGS. 1 and 2.
Figure 4:
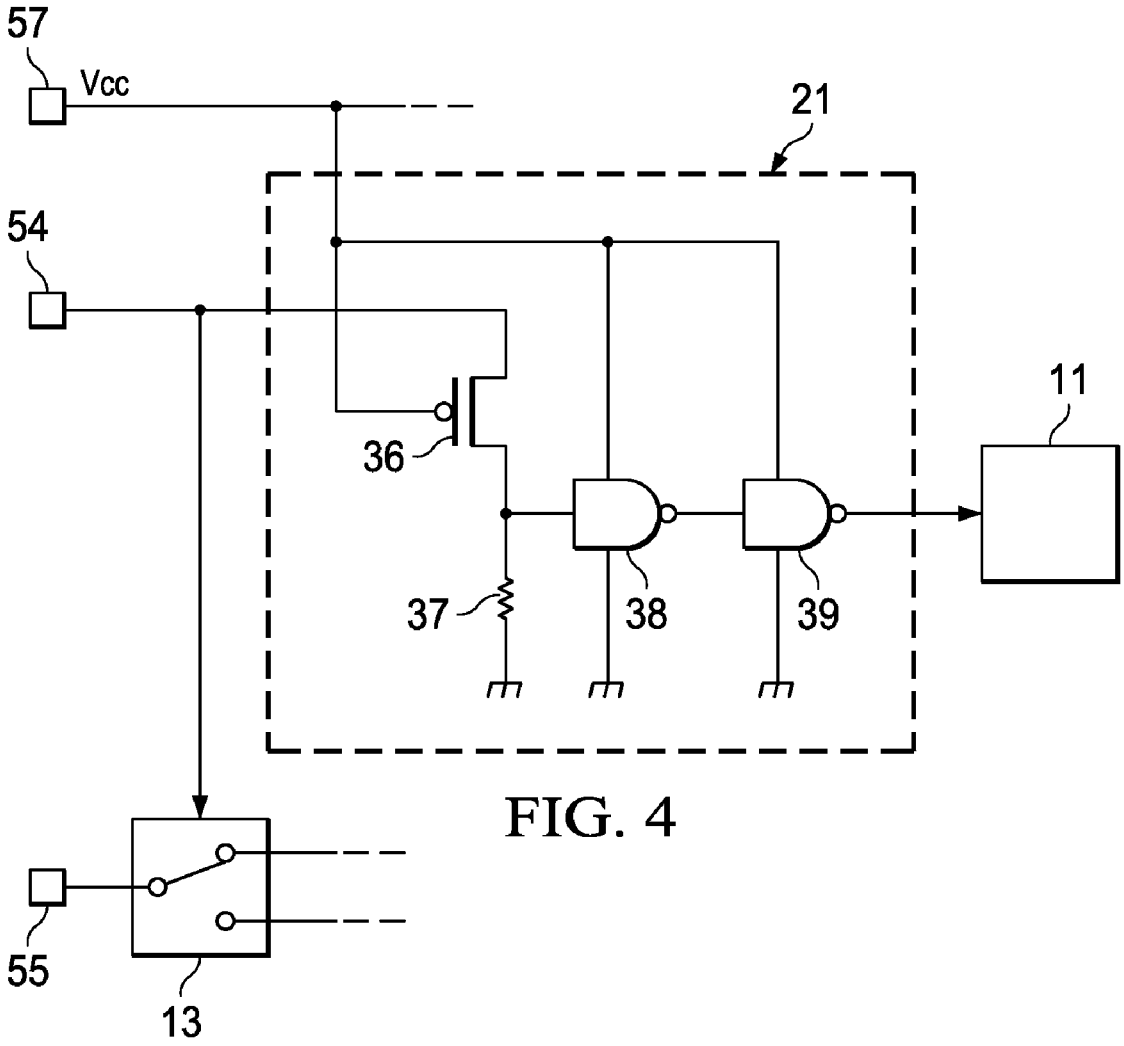
FIG. 4 is a block diagram of signal value detecting circuit in accordance with a preferred embodiment of the present invention.

Turning to FIGS. 2-4, an example of LED controller 10 can be seen in greater detail. The LED controller 10 has current output terminals 51 to which LEDs should be respectively coupled. Within LED controller 10, an LED driving circuit 11 that allows current to flow to current output terminal 51 is used for each current output terminal 51. LED controller 10 also includes a power supply voltage terminal 57. Power supply voltage (Vcc) for operating the internal circuit of LED controller 10 in addition to LED driving circuit 11 is applied to the power supply voltage terminal 57. A shift register 12 is also located in LED controller 10. A data input terminal 52, used for inputting data to shift register 12 from outside LED controller 10, is arranged in the LED controller 10. Light emission data that determines the operational status of LED driving circuit 11 is input to data input terminal 52. Additionally, a storage circuit 22 is arranged inside each LED driving circuit 11.

Shift register 12 is constructed such that it can store light emission data for each of LED driving circuits 11. The light emission data input to data input terminal 52 is input and stored in the shift register in synchronization with a clock signal input from a clock terminal. Within shift register 12, an order is assigned to the areas where the light emission data are stored. When light emission data sent from data input terminal 52 is stored, the light emission data that has been stored is shifted from a previous storage area to a next storage area. The newest light emission data is stored in the forward-most storage area in the sequence, and the light emission data stored in the rear-most storage area overflows out of shift register 12. This light emission data that overflows from shift register 12 is output to data output terminal 53. The data input terminal 52 of LED controller 10 in the forward-most stage of each serially-coupled circuit is coupled to terminal 6. The data input terminal 52 of each LED controller 10 in the second stage and thereafter is coupled to the data output terminal 53 of the LED controller 10 in the previous stage.

In the serially-coupled circuit, the light emission data that overflow from the shift register 12 in the previous LED controller 10 and that is output to data output terminal 53 is input into the next LED controller 10. When light emission data is input to terminal 6, first, the light emission data is input to the LED controller 10 in the forward-most stage, and the light emission data is transferred to the LED controllers 10 in the following stages. Accordingly, the desired light emission data can be sent to LED controller 10 at any position in the serially-coupled circuit. The light emission data is input to terminal 6 as serial data (binary data) having a high voltage level or a low voltage level.

Storage circuit 22 has current value register 32 and duty register 31. The internal output terminal of shift register 12 is coupled to the internal input terminal of current value register 32 and to the internal input terminal of duty register 31. The light emission data stored in shift register 12 are kept in current value register 32 and duty register 31.

LED controller 10 has switch 13 and external latch terminal 56. The current value register 32 and duty register 31 are constructed such that they are coupled to external latch terminal 56 via switch 13. The LED controller also has a switch terminal 54. A switch signal is input to the switch terminal 54. Switch 13 is actuated by the switch signal. Either current value register 32 or duty register 31 is coupled to external latch terminal 56. The switch signal has a low voltage level specified by a predetermined voltage range and a high voltage level specified by a voltage range that does not overlap with the low-voltage range. Also, in this case, a super voltage with an absolute value of the difference between itself and the ground voltage that is larger than the high voltage is specified in a voltage range that does not overlap with the high-voltage range or the low-voltage range. The switch signal is used as a control signal for obtaining either the low voltage or the high voltage or the super voltage.

With the aid of switch 13, current value register 32 and duty register 31 in each LED driving circuit 11 are coupled to external latch terminal 56. If the control signal has low voltage, duty register 31 is coupled to external latch terminal 56. If the control signal has high voltage, current value register 32 is coupled to external latch terminal 56. A latch signal is input to external latch terminal 56. If the latch signal instructs read-in of data after the content stored in shift register 12 has been output to each storage circuit 22, the light emission data output from shift register 12 are input and stored in the register to which the latch signal is supplied. The ordered storage area in shift register 12 and LED driving circuit 11 have a one-to-one correspondence. The light emission data stored in each storage area are stored in the register (storage circuit) of each LED driving circuit 11.

The LED controller 10 also has a signal value detecting circuit 21. Signal value detecting circuit 21 is coupled to switch terminal 54 and power supply voltage terminal 57. The control signal for obtaining low voltage, high voltage, or super voltage is input from switch terminal 54, and power supply voltage Vcc is input from power supply voltage terminal 57.

LED driving circuit 11 also has reference current circuit 30, control circuit 26, and variable current circuit 25. A logic circuit 34 is located in control circuit 26. As will be described later, if the control signal input to switch terminal 54 has low voltage or high voltage, signal value detecting circuit 21 outputs a mode switching signal indicating normal mode. If the input control signal has super voltage, the signal value detecting circuit outputs a mode switching signal indicating test mode to logic circuit 34. Logic circuit 34 is constructed such that the control circuit 26 is operated in normal mode if a mode switching signal indicating normal mode is input, and control circuit 26 is operated in test mode if a mode switching signal indicating test mode is input. As a result, it is possible to switch the operational mode of control circuit 26 depending on a control signal or mode switching signal. In this case, for the mode switching signal, low voltage is set to normal mode, while high voltage is set to test mode.

Current sources 35 are located in variable current circuit 25. A switching circuit 33 is located in control circuit 26. Each current source 35 is constructed such that it is coupled to either reference current circuit 30 or the ground potential depending on switching circuit 33. Switching circuit 33, for example, is generally comprised of two nMOS transistors coupled in series. Depending on the logic state of the output signal of logic circuit 34, one of the transistors conducts, while the other transistor does not conduct. Also, the middle point of the between the two nMOS transistors is coupled to the gate terminal of an nMOS transistor that generally comprises current source 35.

The current sources 35 in one variable current circuit 25 are set such that their currents differ from each other. If the number of current sources 35 set in one variable current circuit 25 is N, a current that is $2^n$ (n is an integer from 0 to N-1, that is, $2^0$, $2^1$, . . . $2^{N-1}$) times the reference current flowing in reference current circuit 30 flows in each current source 35. When a current source 35 in variable current circuit 25 is coupled to reference current circuit 30 by switching circuit 33, a current mirror circuit is generally comprised of the nMOS transistor in current source 35 and the nMOS transistor in reference current circuit 30. A prescribed current is supplied to current output terminal 51 by the current mirror circuit.

When one or more current sources 35 are coupled to reference current circuit 30 by switching circuit 33, a current that is the sum of the currents flowing in each of coupled current sources 35 is drawn into variable current circuit 25 from current output terminal 51. The current flows out to the ground terminal. Preferably, six current sources 35 are present. Therefore, the currents flowing in the current sources are 1, 2, 4, 8, 16, and 32 times the reference current.

The light emission data stored in current value register 32 are is generally of the number of current sources 35 and the same number of bits. Each bit and current source 35 have a one-to-one correspondence. A desired current source 35 can be coupled to reference current circuit 30 depending on the value of the light emission data.

The light emission data stored in current value register 32 are input to selection circuit 24, converted to a selection signal in selection circuit 24, and output to logic circuit 34. In normal mode, only the current source 35 selected by the selection signal from current sources 35 can be coupled to reference current circuit 30. Consequently, when the value of the light emission data stored in current value register 32 is changed, $2^N$ currents, varying from zero times the current of reference current circuit 30 to $(2^N-1)$ times the current, can flow to current output terminal 51. In this case, since N=6, 128 currents formed by combining 64 current values from zero times to 63 times can flow to current output terminal 51.

On LED backlight panel 5, due to the variation in the characteristics of LEDs 18, even if the same current flows through LEDs 18, the brightness of the emitted light is different. Therefore, the current value at which each LED 18 can emit light with the same brightness is derived for each LED 18 and is stored in duty register 31 coupled to each LED 18. When LED 18 is turned on, if a current with the current value flows, the characteristic variation of LED 18 can be compensated.

The LED controller 10 has a light-on switch terminal 56. If the light-on signal input to light-on switch terminal 56 indicates that the light can be turned on, PWM circuit 23 outputs a PWM signal that repeats a conduction instruction and cutoff instruction at a frequency of tens of Hz or higher to logic circuit 34. If the light-on signal indicates enforced light-off, no PWM signal will be output. The light emission data stored in duty register 31 show the duty ratio of the conduction period and cutoff period of the PWM signal. The duty ratio of the PWM signal output by PWM circuit 23 has a magnitude indicated by light emission data stored in duty register 31.

In addition to the PWM signal output from PWM circuit 23 and the selection signal output from selection circuit 24, a test signal (to be described later, in this example, the light-on signal is used as the test signal) and the mode switching signal are also input into logic circuit 34. If the mode switching signal is in normal mode, logic circuit 34 ignores the test signal and controls switching circuit 33 based on the PWM signal output from PWM circuit 23 and the selection signal output from selection circuit 24 (logic product of the PWM signal and the selection signal). The selected current source 35 is coupled to reference current circuit 30 during the period when the PWM signal indicates conduction (conduction period) and is coupled to the ground potential during the period when the signal indicates cutoff (cutoff period). As a result, repetitious current flows intermittently to current output terminal 51, and the LED 18 coupled to current output terminal 51 flashes at the duty ratio of the PWM signal. In this case, although the LED flashes, it is visually recognized as continuous light emission. This is the operation in normal mode. Each LED 18 emits light at the same light emission intensity during the conduction period, according to the light emission data stored in current value register 32. However, since the duty ratio of the conducting instruction will change when the light emission data stored in duty register 31 are changed, the light emission intensity of LED backlight panel 5 can be partially varied. As an example, the light emission data stored in duty register 31 have 12 bits. Since LED 18 can be turned on/off at 4096duty values including zero, each LED 18 can emit light at an average light quantity of 4096 duty ratios.

If the light-on signal indicates enforced light-off, no PWM signal is output from PWM circuit 23. Even if the mode switching signal indicates normal mode, no current flows to current output terminal 51. On the other hand, if the mode switching signal input to control circuit 26 indicates test mode, logic circuit 34 will ignore the selection signal output from selection circuit 24 and the PWM signal output from PWM circuit 23 and will operate according to a test signal (test mode). If the test signal indicates light-on, all of the current sources 35 are coupled to reference current circuit 30, and the maximum current flows to current output terminal 51. LEDs 18 are turned on by the maximum current. If the test signal indicates light-off, all of the current sources 35 are cut off from reference current circuit 30, and no current flows to current output terminal 51. In this case, the light-on signal is used for the test signal. If the light-on signal indicates that lights can be turned on, light-on will be instructed. If the light-on signal indicates enforced light-off, light-off will be instructed.

As described above, since LEDs 18 coupled to current output terminal 51 can be turned on/off depending on the test mode signal and the test signal independent of the light emission data stored in shift register 12 or current value register 32 or duty register 31, all light-on or all light-off tests can be carried out easily.

FIG. 4 shows an example of signal value detecting circuit 21. Signal value detecting circuit 21 has a p-channel MOS transistor 36 with its source terminal coupled to switch terminal 54. The gate terminal of the p-channel MOS transistor 36 is coupled to power supply voltage terminal 57, and its drain terminal is coupled to the ground potential via voltage detector resistor 37. The p-channel MOS transistor 36 is turned off if the voltage at switch terminal 54 is low voltage or high voltage, and a low-level mode switching signal is output from signal value detecting circuit 21 via inverters 38, 39. The high voltage is identical to the power supply voltage Vcc supplied to power supply voltage terminal 57. On the other hand, if a super voltage higher than the high voltage is applied to switch terminal 54, p-channel MOS transistor 36 is turned on, and a high level mode switching signal is output from signal value detecting circuit 21.

Accordingly, the light-on signal is used as the test signal. However, another test signal can be used as long as it is not a signal used in the test mode and can be easily controlled from an external terminal. Additionally, a super voltage is added to the switching signal that changes the status of switching circuit 13 depending on low voltage and high voltage to generate the control signal for creating the mode switching signal. However, the super voltage can also be added to other signals, such as the latch signal, to generate the mode switching signal.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Accordingly, it is appropriate that the appended claims be construed broadly and in a manner consistent with the scope of the invention.

The invention claimed is:

1. An apparatus comprising:

a shift register that sequentially stores light emission data input from a data input terminal and overflows the light emission data exceeding the storage capacity;

a switch terminal that is adapted to receive a switch voltage;

a detector that is coupled to the switch terminal and that compares the switch voltage to a predetermined voltage;

a plurality of current output terminals, wherein each current output terminal is adapted to be coupled to an LED; and a plurality of LED drivers, wherein each LED driver is coupled to at least one of the current output terminals and to the detector, and wherein each LED driver that includes:

a storage circuit that is coupled to the shift register and that stores light emission data from the shift register;

a pulse width modulation (PWM) circuit that is coupled to the storage circuit;

a selection circuit that is coupled to the storage circuit;

a control circuit that is coupled to PWM circuit and the selection circuit; and a variable current circuit that is coupled to the control circuit and to its associated current output terminal.

2. The apparatus of claim 1, wherein the apparatus further comprises:

a latch terminal; and a switch having an input, a first output, and a second output, wherein the input is coupled to the latch terminal, and wherein the first output is coupled to each PWM circuit, and wherein the second output is coupled to each selection circuit, and wherein the switch is controlled by the switch voltage.

3. The apparatus of claim 1, wherein each control circuit further comprises:

a plurality of logic circuits, wherein each logic circuit is coupled to the selection circuit, its associated PWM circuit, and its associated selection circuit; and a plurality of switching circuits, wherein each switching circuit is coupled between at least one of the logic circuits and its associated variable current circuit.

4. The apparatus of claim 1, wherein the detector further comprises:

a PMOS transistor that is coupled to the switching terminal at its source;

a resistor that is coupled to the drain of the PMOS transistor;

a first inverter that is coupled to the drain of the PMOS transistor; and a second inverter that is coupled to the first inverter.

5. The apparatus of claim 1, wherein each storage circuit further comprises:

a current value register that is coupled to the shift register and to its associated PWM circuit; and a duty register that is coupled to the shift register and to its associated selection circuit.

6. An apparatus comprising:

a plurality of light emitting diode (LED) sets, wherein each set includes a plurality of LEDs;

a plurality of LED controllers arranged in a plurality of rows, wherein each LED controller is coupled to the LEDs associated with at least one of LED sets, and wherein the LED controllers of each row are coupled in series to one another, and wherein each LED controller includes:

a shift register that sequentially stores light emission data input from a data input terminal and overflows the light emission data exceeding the storage capacity;

a switch terminal that is adapted to receive a switch voltage;

a detector that is coupled to the switch terminal and that compares the switch voltage to a predetermined voltage;

a plurality of current output terminals, wherein each current output terminal is adapted to be coupled to at least one of the LEDs; and a plurality of LED drivers, wherein each LED driver is coupled to at least one of the current output terminals and to the detector, and wherein each LED driver that includes:

a storage circuit that is coupled to the shift register and that stores light emission data from the shift register;

a pulse width modulation (PWM) circuit that is coupled to the storage circuit;

a selection circuit that is coupled to the storage circuit;

a control circuit that is coupled to PWM circuit and the selection circuit; and a variable current circuit that is coupled to the control circuit and to its associated current output terminal.

7. The apparatus of claim 6, wherein the apparatus further comprises:

a latch terminal; and a switch having an input, a first output, and a second output, wherein the input is coupled to the latch terminal, and wherein the first output is coupled to each PWM circuit, and wherein the second output is coupled to each selection circuit, and wherein the switch is controlled by the switch voltage.

8. The apparatus of claim 6, wherein each control circuit further comprises:

a plurality of logic circuits, wherein each logic circuit is coupled to the selection circuit, its associated PWM circuit, and its associated selection circuit; and a plurality of switching circuits, wherein each switching circuit is coupled between at least one of the logic circuits and its associated variable current circuit.

9. The apparatus of claim 6, wherein the detector further comprises:

a PMOS transistor that is coupled to the switching terminal at its source;

a resistor that is coupled to the drain of the PMOS transistor;

a first inverter that is coupled to the drain of the PMOS transistor; and a second inverter that is coupled to the first inverter.

10. The apparatus of claim 6, wherein each LED set further comprises 16 LEDs.

11. The apparatus of claim 6, wherein each LED controller further comprises:

an input terminal that is coupled to its associate shift register; and an output terminal that is coupled to its associated shift register, wherein the output terminal is adapted to be coupled to input terminal of another LED controller.

12. The apparatus of claim 6, wherein each storage circuit further comprises:

a current value register that is coupled to its associated shift register and to its associated PWM circuit; and a duty register that is coupled to its associated shift register and to its associated selection circuit.

* * * * *